US011616311B1

(12) United States Patent
Wei et al.

(10) Patent No.: US 11,616,311 B1
(45) Date of Patent: Mar. 28, 2023

(54) ELECTRICAL CONNECTOR FASTENER ASSEMBLY

(71) Applicant: Drow Enterprise Co., Ltd., Tainan (TW)

(72) Inventors: Cheng Tsung Wei, Tainan (TW); Ying Chieh Wei, Tainan (TW)

(73) Assignee: Drow Enterprise Co., Ltd., Tainan (TW)

( * ) Notice: Subject to any disclaimer, the term of this patent is extended or adjusted under 35 U.S.C. 154(b) by 0 days.

(21) Appl. No.: 17/572,774

(22) Filed: Jan. 11, 2022

(51) Int. Cl.
*H01R 4/30* (2006.01)

(52) U.S. Cl.
CPC ..... *H01R 4/30* (2013.01)

(58) Field of Classification Search
CPC ... H01R 4/30; H01R 4/50; H01R 4/38; H01R 4/302; H01R 4/44; F16B 2001/0064
See application file for complete search history.

(56) References Cited

U.S. PATENT DOCUMENTS 4,362,351 A * 12/1982 Wible ..... H02K 5/225 439/926
5,108,296 A * 4/1992 Takano ..... H01R 4/64 439/573
7,128,345 B2 * 10/2006 Bartholoma ..... H02G 15/04 285/137.11
7,290,334 B2 * 11/2007 Pettersen ..... F16B 5/0258 29/882
7,886,439 B2 * 2/2011 Braden ..... H01R 4/646 29/854
8,092,129 B2 * 1/2012 Wiley ..... F16B 19/1054 411/160
9,209,531 B2 * 12/2015 Erdle ..... H01R 31/06
9,225,080 B2 * 12/2015 Himeno ..... H01R 25/16
9,520,658 B1 * 12/2016 Schmit ..... H01R 4/302
2006/0231285 A1 * 10/2006 Bisson ..... F16B 37/043 174/94 R
2015/0248975 A1 * 9/2015 Bonfanti ..... H01R 13/213 200/50.28

* cited by examiner

*Primary Examiner* — Vanessa Girardi
(74) *Attorney, Agent, or Firm* — Karin L. Williams; Alan D. Kamrath; Mayer & Williams PC

(57) ABSTRACT

An electrical connector assembly is installed on a plate having a polygonal through hole and composed of an external rotating member, a locking rod, an outer tension ring, an inner tension ring and a locking part. The relatively larger sized external rotating member, the push handle shaped outer wall and the ridge pattern for durable handheld operation provide an easy convenient operation for both reverse or forward rotations. The outer tension ring has a multi-protrusion block plugged into a polygonal through hole of the plate and a polygonal groove of the inner tension ring to achieve the effect of engaging with the polygonal plug and the locking rod is screwed with the nut and the locking part to achieve the pressing effect, such that the outer tension ring, the plate and the inner tension ring can be pressed and attached securely with each other.

6 Claims, 8 Drawing Sheets

ELECTRICAL CONNECTOR FASTENER ASSEMBLY

BACKGROUND OF THE INVENTION

Field of the Invention

The present invention relates to an electrical connector assembly, and more particularly to the electrical connector assembly with the features of convenient operation and high assembling stability.

Description of the Related Art

Electrical connector generally refers to a part of a joint that can achieve an electric connection of a circuit, and there are many types of electrical connector assemblies. With reference to FIGS. 1 to 3 for a conventional electrical connector 10, the conventional electrical connector 10 is installed on a plate 11 for use. The plate 11 can be an independent plate or one of the plates that is assembled into an electrical box. In other words, the use of the conventional electrical connector 10 is not limited by the type of the plate to which it is installed. The conventional electrical connector 10 is composed of an outer rod 12, an outer tension ring 13, an inner tension ring 14 and a locking part 15. The outermost end of the outer rod 12 is an operable rotating ring 121 with a hollow interior, and a metal electrical connection rod is fixed to an inner section of the hollow interior, and a head section 122 of the electrical connection rod is manufactured into the shape of a ring and fixed to the rotating ring 121, and a power slot 1221 is formed and penetrated in the head section 122, and a limit ring 123 is formed behind the head section 122 of the electrical connection rod and attached precisely with the back of the rotating ring 121. A section of the assembly rod portion 124 is a screw rod portion 125 extended backward, and an inner end of the outer tension ring 13 has a passing portion 131 that can pass through a through hole 111 on the plate 11 for the installation purpose, such that the outer ring portion of the outer tension ring 13 can stay on the outer side of the plate 11. The outer tension ring 13 is axially penetrated through a perforated slot 132 and provided for the assembly rod portion 124 of the outer rod 12 to pass from the outer side and stay inside. The screw rod portion 125 is passed through and out from the perforated slot 132, and the outer periphery of the passing portion 131 has a flat abutment surface, and the inner tension ring 14 has a ring-shaped wall and an axially penetrated interior, and the inner wall of the inner tension ring 14 has a flat abutment surface. When the inner wall of the inner tension ring 14 is sheathed on the outer periphery of the passing portion 131, the abutment surface of the inner wall of the inner tension ring 14 will be attached to the abutment surface of the outer periphery of the passing portion 131, such that the inner tension ring 14 and the passing portion 131 are attached with each other and will not be rotated relative to each other, and the inner tension ring 14 can press the inner side of the plate 11. In other words, the outer tension ring 13 and the inner tension ring 14 are abutted against (or attached to) the outer side or inner side of the plate 11, and then an object such as a washer 151 can be sheathed on the screw rod portion 125 first, and then the locking part 15 is provided to lock the screw rod portion 125 securely, and its operation is to rotate the rotating ring 121 and the locking part 15 relative to each other, such that the outer tension ring 13 and the inner tension ring 14 jointly and tightly clamp the plate 11, and the whole outer rod 12 is pulled in a direction towards the inside, and the whole electrical connector 10 is tightly attached onto the plate 11 (as shown in FIG. 2). During use, a circuit 152 is clamped tightly between the washer 151 and the locking part 15 in advance (as shown in FIG. 3) and electrically conducted to the rear end (which can be a circuit or a loop) to complete the electric conduction with a circuit inside the plate 11. Other circuits outside the plate 11 can be electrically conducted by the following two modes. In the first mode, a power slot 1221 inside the head section 122 of the electrical connection rod is provided for plugging an external conductive rod (which may be connected to an external power supply) and conducted by the electrical connection rod to produce an electric conduction effect with the circuit 152. In the second mode, the method of plugging the conductive rod into the power slot 1221 is not used, but a circuit 153 clamped tightly between the limit ring 123 and the outer tension ring 13 as shown in FIG. 3 is used instead, and then the electrical connection rod is electrically connected to produce the electric conduction effect with the circuit 152.

In the application of the conventional electrical connector 10, the rotating ring 121 has a relatively smaller size, so that the operation and rotation are relatively uneasy, and the outer tension ring 13 and the inner tension ring 14 just rely on the attachment with the abutment surface to achieve the expected effect of not rotating relative to each other. However, the effect of non-rotating relative with each other will gradually die down due to the worn-out after a long time of use. As a result, the overall assembly of the electrical connector 10 will gradually become loosened and even will lead to a short circuit. Obviously, the conventional electric connector requires improvements.

SUMMARY OF THE INVENTION

In view of the aforementioned drawbacks, the inventor of the present invention based on years of experience in the related industry to conduct extensive research and experiment, and finally developed an electrical connector assembly to overcome the drawbacks of the prior art.

It is a primary objective of the present invention to provide an electrical connector assembly with the features of convenient operation and high assembling stability.

To achieve the above-mentioned objective, the present invention provides an electrical connector assembly, installed on a plate, the plate having a polygonal through hole formed thereon, and the electrical connector assembly comprising an external rotating member, a locking rod, an outer tension ring, an inner tension ring and a locking part, wherein the external rotating member has an outer wall formed into a push handle shape and an inner surface with a screw slot; the locking rod is a long-rod shaped screw, screwed with a locking nut, and an end of the locking rod is screwed into the screw slot to reach a screwing length, and the locking nut is rotated to press the inner surface of the external rotating member; the outer tension ring axially penetrates through a through hole and has an inwardly concave polygonal slot formed on an outer surface thereof and an inner surface with a multi-protrusion block, and the polygonal slot is configured to be corresponsive to the locking nut, and the multi-protrusion block is configured to be corresponsive to the polygonal through hole of the plate, and the outer tension ring is passed through the through hole and sheathed on the locking rod, such that the locking nut is pressed into the polygonal slot, and then the outer tension ring is attached to the outer surface of the plate, such that the multi-protrusion block of the outer tension ring is plugged into the polygonal through hole, while the locking rod is passed through the polygonal through hole of the plate; the inner tension ring is axially passed through a through hole and has an outer surface with a polygonal groove, and the polygonal groove is configured to be corresponsive to the polygonal through hole of the plate and corresponsive to the multi-protrusion block of the outer tension ring, and the inner tension ring is attached to an inner surface of the polygonal through hole of the plate, and the locking rod is passed through the through hole of the inner tension ring, and the multi-protrusion block of the outer tension ring is plugged into the polygonal groove of the inner tension ring, and a rear end of the inner tension ring is sheathed on the locking rod by a washer, and the locking part is screwed with the corresponding locking rod.

According to the above-mentioned electrical connector assembly, wherein the push handle shaped outer wall of the external rotating member has a ridge pattern for a durable handheld operation.

According to the above-mentioned electrical connector assembly, wherein the external rotating member has a polygonal plug slot formed on an outer surface thereof and provided for plugging a tool.

According to the above-mentioned electrical connector assembly, wherein the locking part is comprised of two nuts, and two nuts are screwed tightly with each other to enhance the pressing effect between the locking rods.

According to the above-mentioned electrical connector assembly, wherein the two nuts of the locking part are provided for clamping and coupling a circuit therebetween.

According to the above-mentioned electrical connector assembly, wherein the inner surface of the external rotating member and the locking nut are provided for clamping and coupling a circuit therebetween, and the circuit is coupled to the locking rod, such that the circuit is electrically coupled to the circuit clamped and coupled between the two nuts of the locking part.

DETAILED DESCRIPTION OF THE PREFERRED EMBODIMENTS

The adopted technical means and achievable effects of the present invention will be apparent with the detailed description accompanied with related drawings of preferred embodiments as follows.

Figure 1:
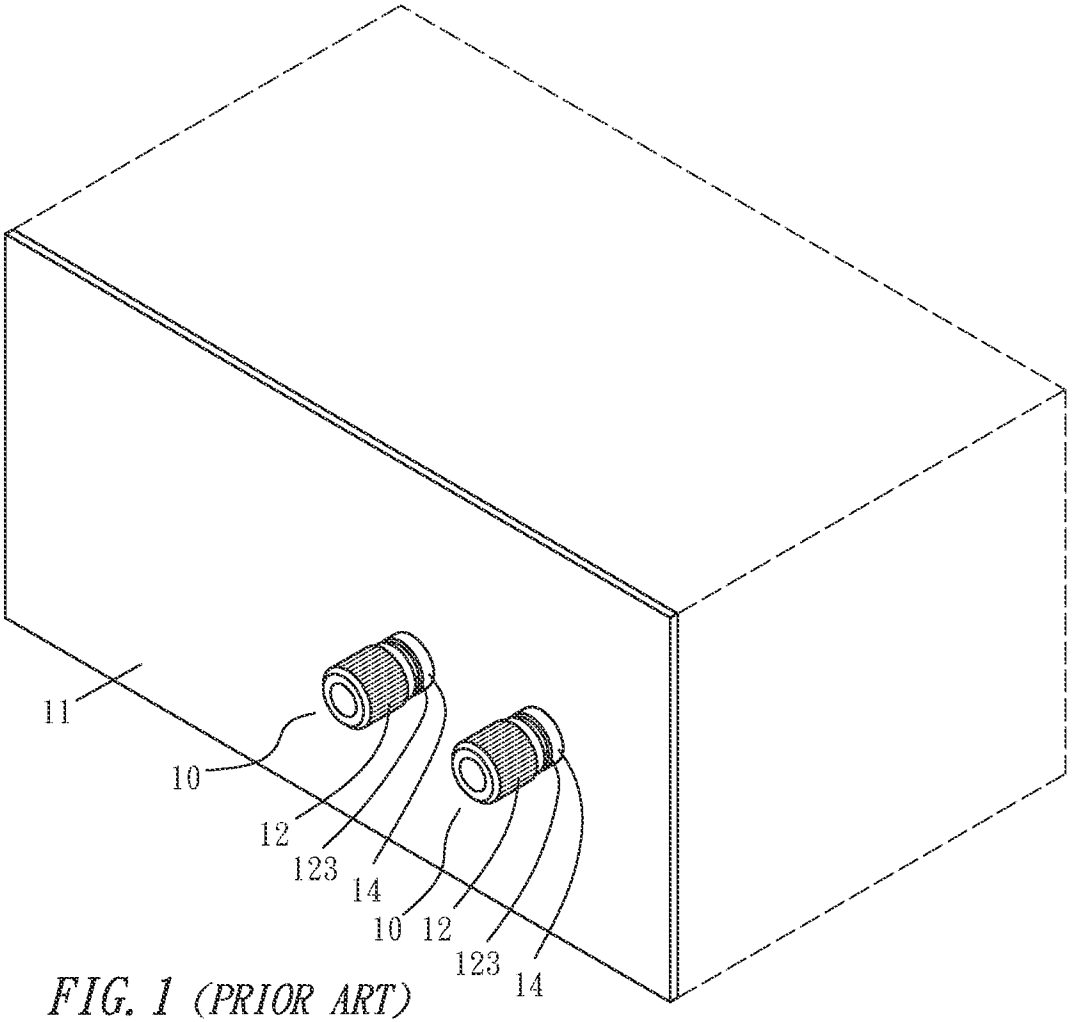
FIG. 1 (PRIOR ART)
FIG. 1 is a perspective view of a prior art.
Figure 3:
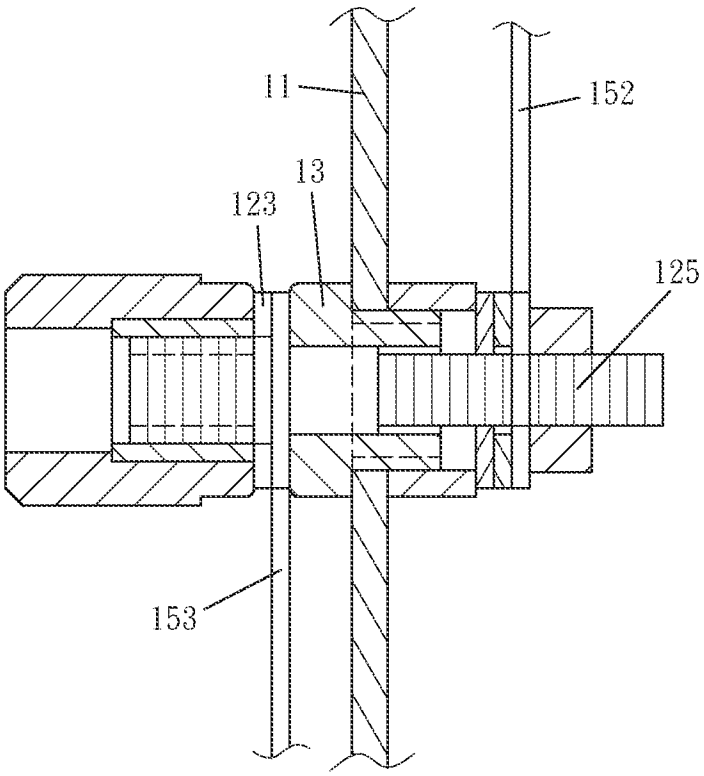
FIG. 3 (PRIOR ART)
FIG. 3 is a cross-sectional view showing an application of a prior art.
Figure 2:
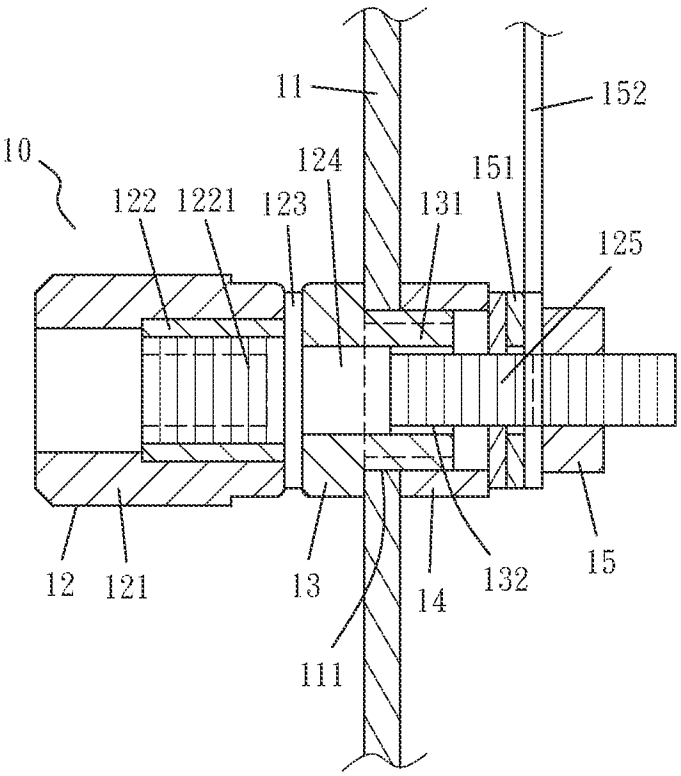
FIG. 2 (PRIOR ART)
FIG. 2 is a cross-sectional view of a prior art.
Figure 4:
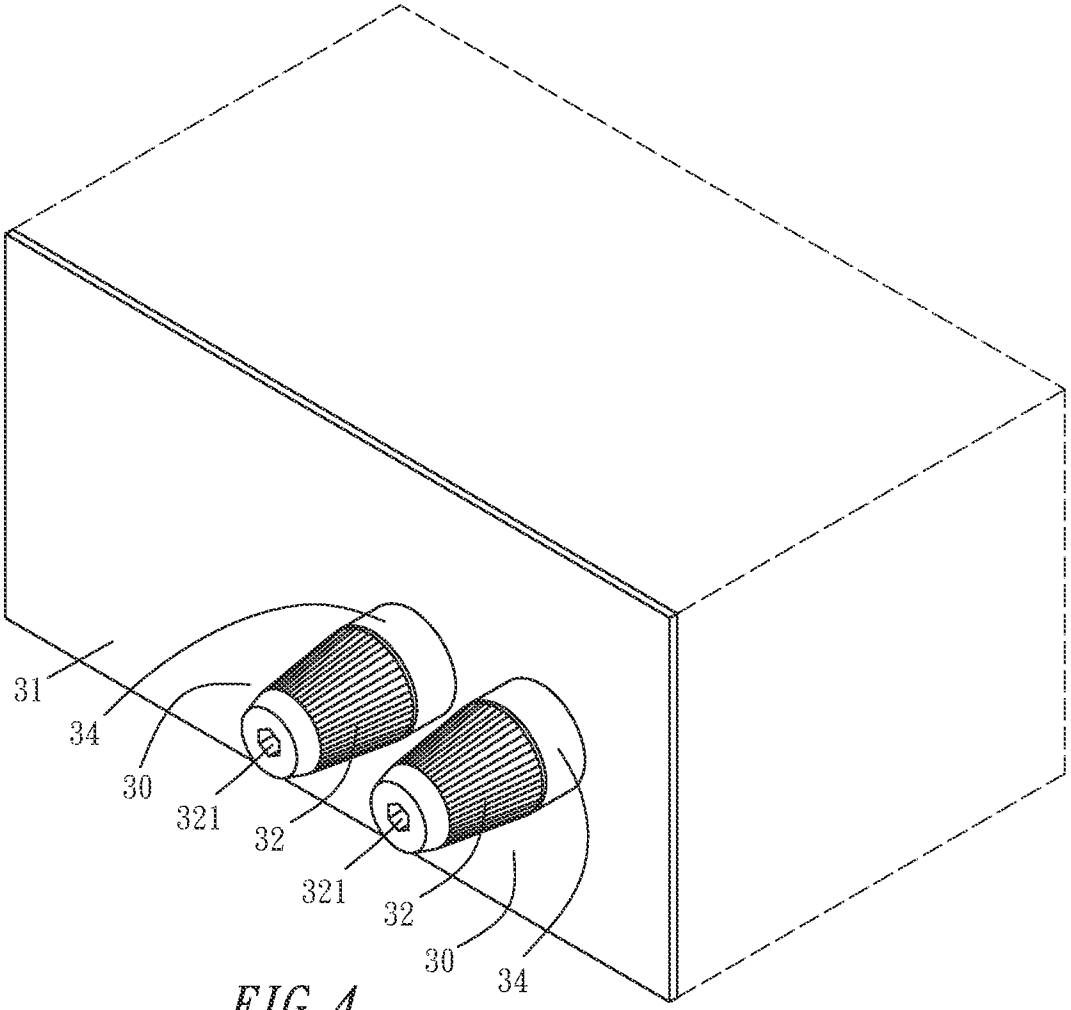
FIG. 4 is a perspective view of an embodiment of the present invention.
Figure 5:
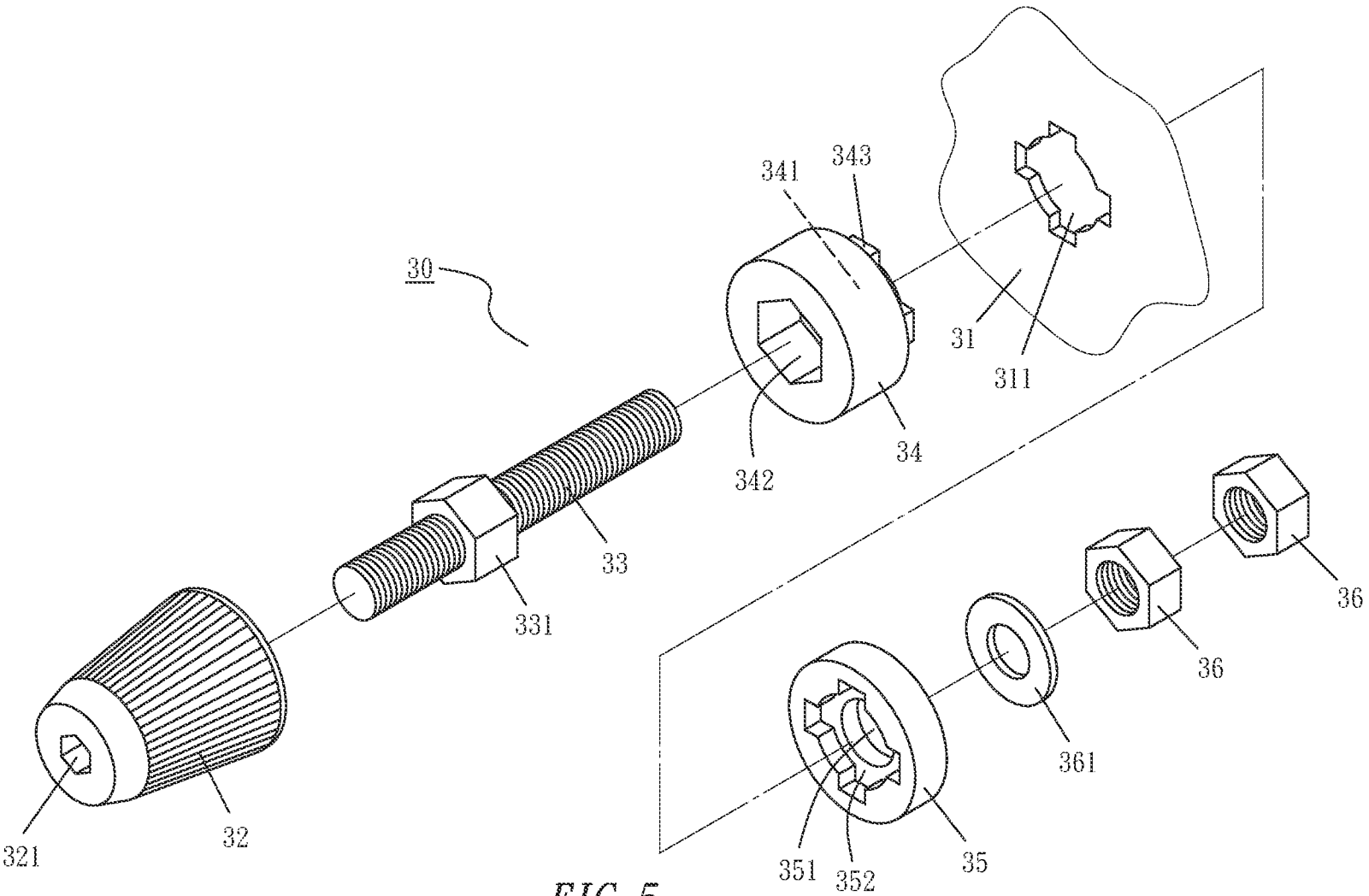
FIG. 5 is a first exploded view of an embodiment of the present invention.
Figure 6:
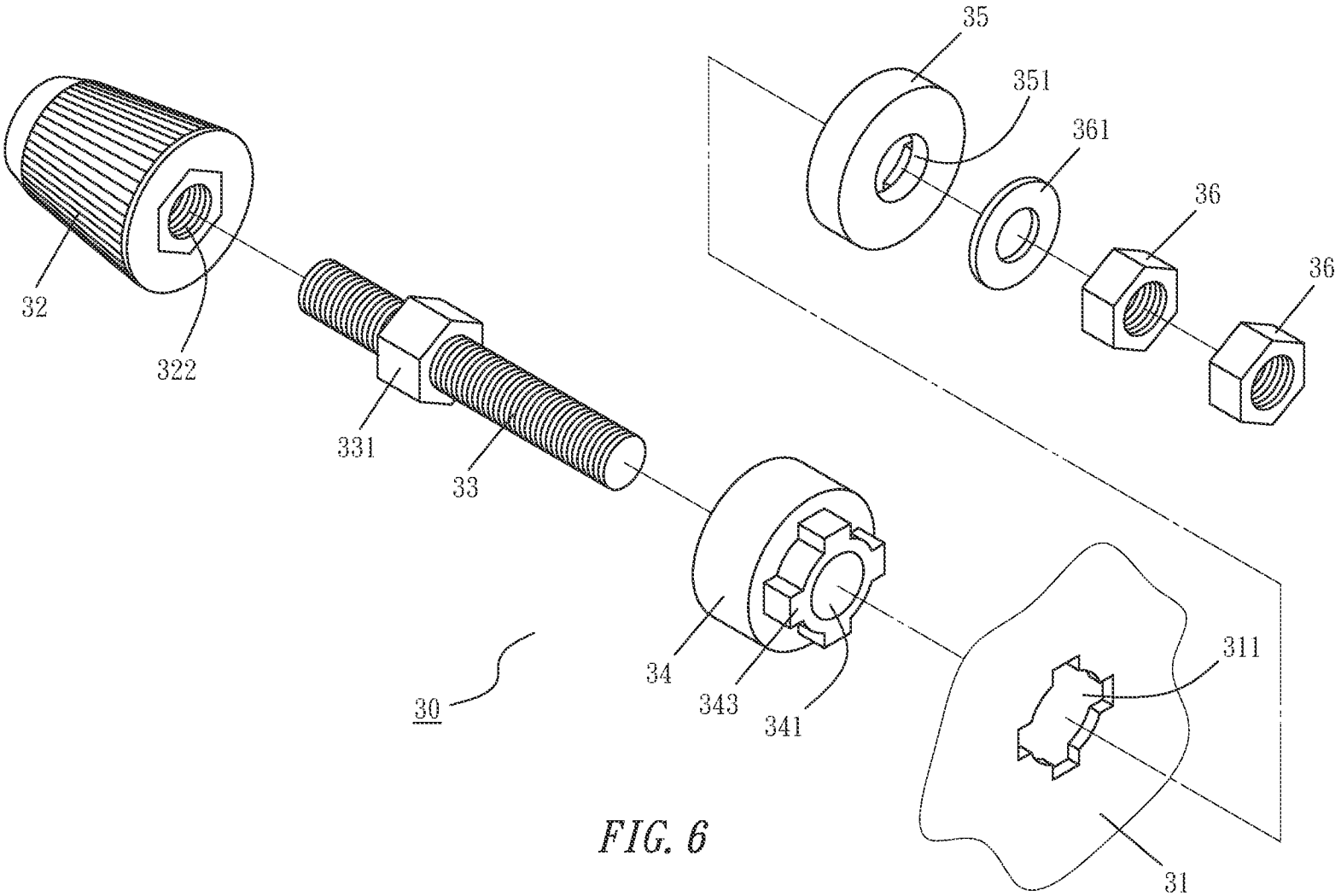
FIG. 6 is a second exploded view of an embodiment of the present invention.
Figure 7:
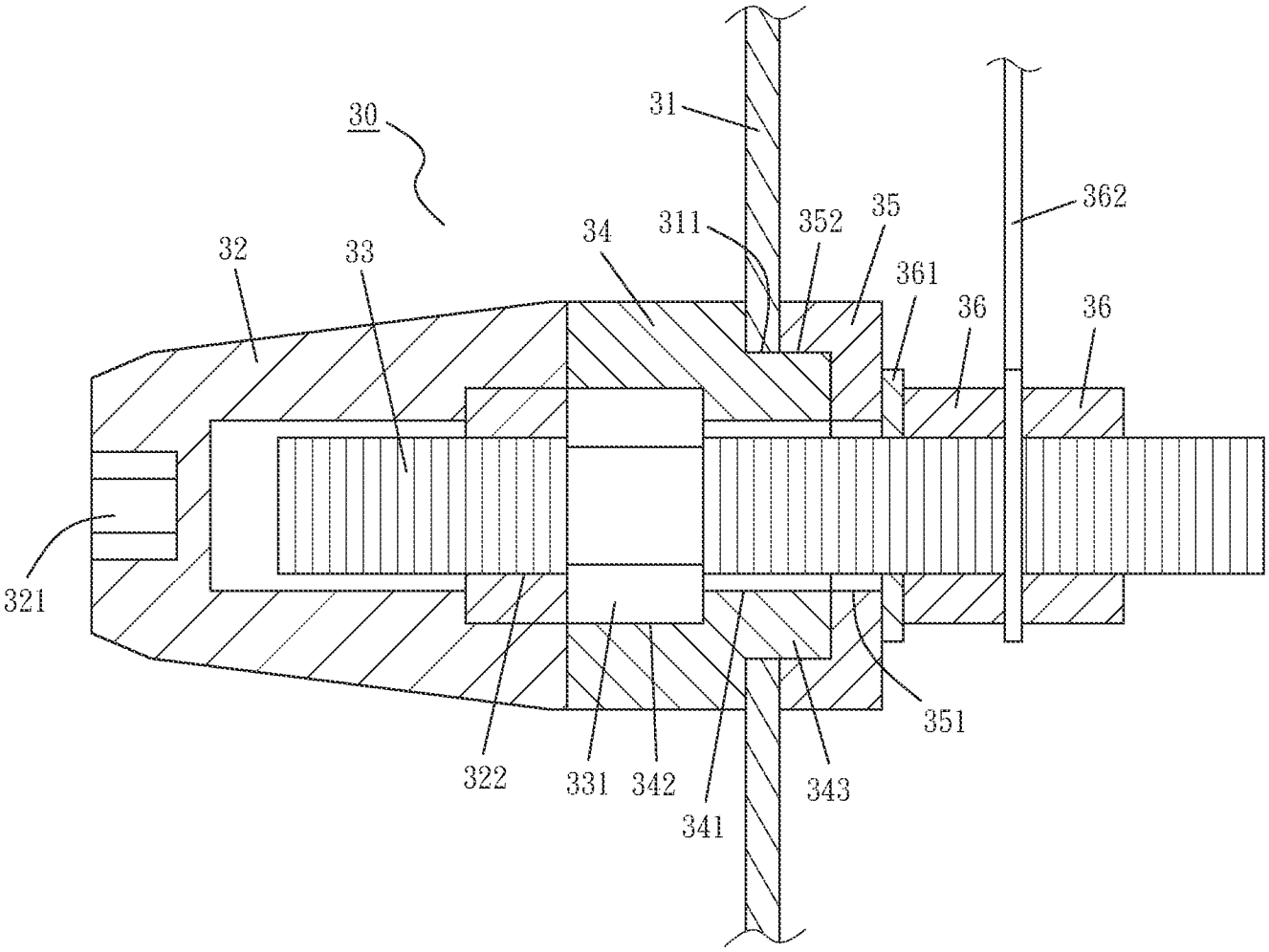
FIG. 7 is a cross-sectional view of an embodiment of the present invention.

With reference to FIGS. 4-8 for an electrical connector 30 in accordance with an embodiment of the present invention, the electrical connector 30 is installed on a plate 31 for use, and has a polygonal through hole 311 formed at a selected position on the plate 31, and the plate 31 can be a standalone plate, or one of the plates for assembling into an electrical box, so that the way of installing the electrical connector 30 on the plate for use is not limited. The electrical connector 30 is comprised of an external rotating member 32, a locking rod 33, an outer tension ring 34, an inner tension ring 35 and a locking part 36. The external rotating member 32 has an outer wall formed into a push handle shaped wall and further has a ridge pattern for an easy durable operation, and the outer surface of the external rotating member 32 has a polygonal plug slot 321 provided for inserting a tool, and the inner surface of the external rotating member 32 has a screw slot 322. The locking rod 33 is a long-rod shaped screw with a locking nut 331 screwed on the rod, and an end of the locking rod 33 can be screwed directly into the screw slot 322 to an appropriate screwing length, and then the locking nut 331 on the locking rod 33 can be rotated to press the inner surface of the external rotating member 32 tightly, so that the external rotating member 32, the locking rod 33 and the locking nut 331 can be pressed tightly and combined into an assembly. The outer tension ring 34 is axially penetrated through a through hole 341, and the outer surface of the outer tension ring 34 has an inwardly concave polygonal slot 342, and the inner surface of the outer tension ring 34 has a multi-protrusion block 343, and the polygonal slot 342 is in a shape corresponding to that of the locking nut 331, so that the outer tension ring 34 can be passed through the through hole 341 and sheathed on the locking rod 33 to achieve the effect of pressing the locking nut 331 into the polygonal slot 342. The multi-protrusion block 343 is in a shape corresponding to the polygonal through hole 311 of the plate 31, so that when the outer tension ring 34 is attached and installed onto the outer surface of the plate 31, the outer tension ring 34 can be inserted from the multi-protrusion block 343 into the polygonal through hole 311 to achieve the non-rotating status of the outer tension ring 34 relative to the plate 31. In the meantime, the locking rod 33 is passed through the polygonal through hole 311 of the plate 31. The inner tension ring 35 is axially penetrated through a through hole 351, and the outer surface has a polygonal groove 352 which is in the same shape as the polygonal through hole 311 of the plate 31 and corresponding to that of the multi-protrusion block 343 of the outer tension ring 34, so that when the inner tension ring 35 is attached onto an inner surface of the polygonal through hole 311 of the plate 31, the inner tension ring 35 can be passed from the locking rod 33 through the through hole 351 of the inner tension ring 35. In the meantime, the multi-protrusion block 343 of the outer tension ring 34 can be plugged into a polygonal groove 352 of the inner tension ring 35 precisely to achieve the non-rotating status, and then the rear end of the inner tension ring 35 can be sheathed on the locking rod 33 by a washer 361, and then the locking part 36 is screwed with the corresponding locking rod 33, wherein the locking part 36 is composed of two nuts, and the tight screwing effect of the two nuts can enhance the pressing effect with the locking rod 33, so that the locking rod 33, the nut 331 and the locking part 36 can be screwed and pressed tightly with one another to press and combine the outer tension ring 34, the plate 31 and the inner tension ring 35. Therefore, the whole electrical connector 30 will be tightly attached on the plate 31 as shown in FIG. 7.

Figure 8:
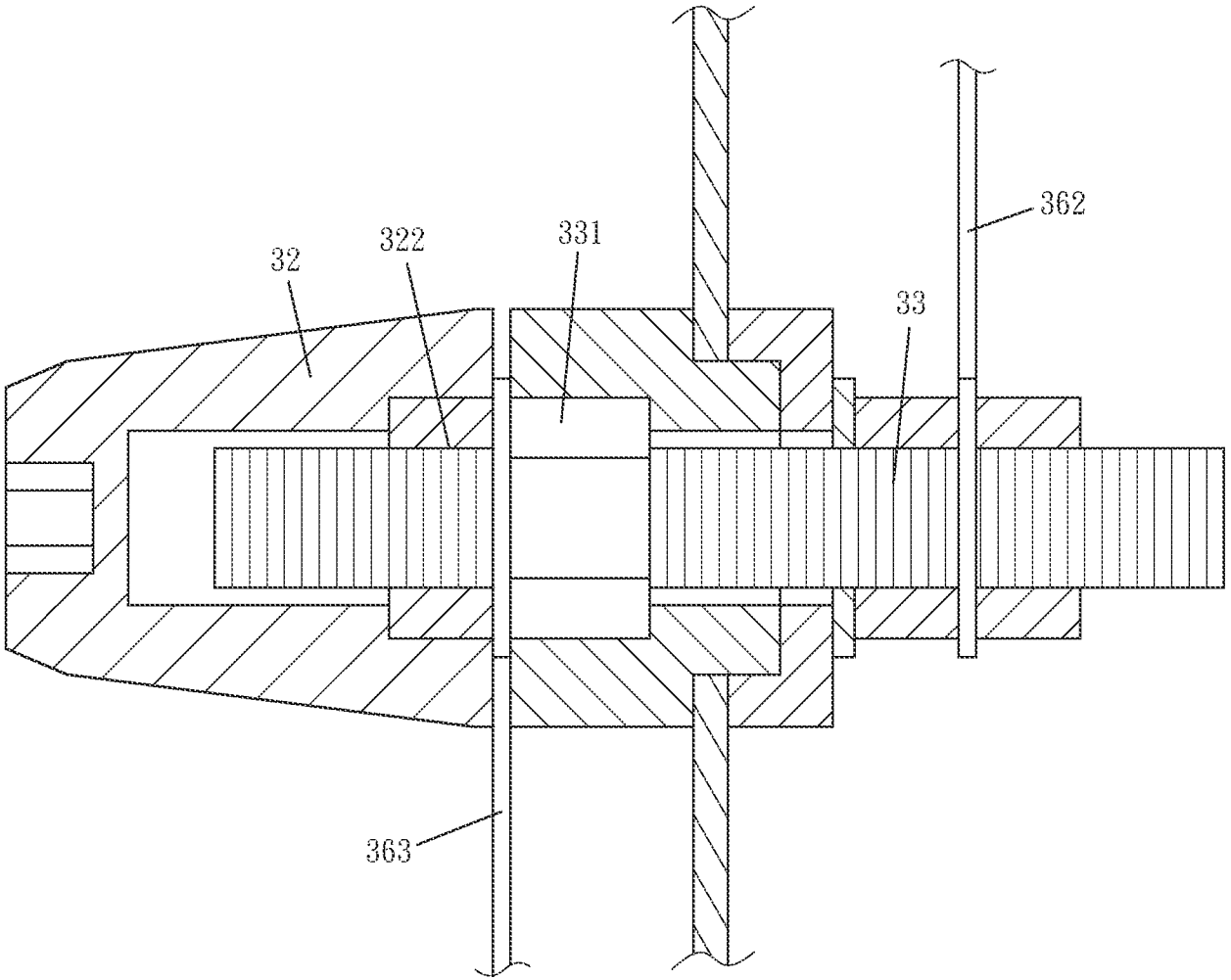
FIG. 8 is a cross-sectional view showing an application of an embodiment of the present invention.
Figure 9:
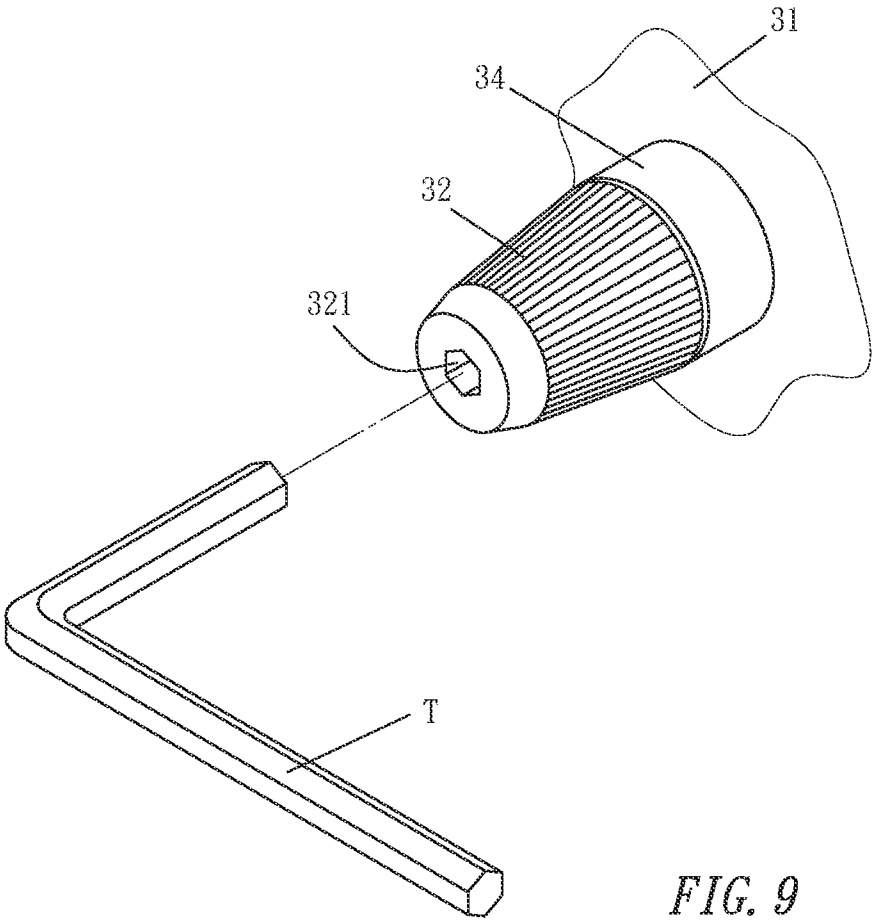
FIG. 9 is an exploded view showing an external rotating member rotated by a tool in accordance with the present invention.

When use, a circuit 362 can be clamped by the two nuts of the locking part 36 first as shown in FIG. 7 and conducted to a rear end (which can be a circuit or a loop) to complete the electrical conduction with a circuit in the plate 31, and then a circuit outside the plate 31 can be conducted as shown in FIG. 8, and the external rotating member 32 is slightly turned over, such that there is a small gap between the inner surface of the external rotating member 32 and the locking nut 331, and then a circuit 363 can be passed and entered into the gap by a terminal clamp to circularly clamp the locking rod 33, and then the external rotating member 32 is rotated in a forward rotational direction to clamp the terminal clamp of the circuit 363 between the screw slot 322 and the locking nut 331. With the connection of the locking rod 33, the circuit 363 can produce an electrical conduction effect with the circuit 362. Sometimes because the external rotating member 32 is rotated very hard, the inner surface of the external rotating member 32 and the locking nut 331 are closely attached, and the external rotating member 32 cannot be rotated in a reverse direction. At this time, as shown in FIG. 9, an end of a suitable tool T is inserted into the polygonal plug slot 321 formed on the outer surface of the external rotating member 32, and then the tool T is rotated to increase the torque to help rotating the external rotating member 32, regardless of the forward or reverse rotation.

In the description above, the external rotating member 32 has a relatively larger size (compared with the conventional rotating ring 121), and there is a push handle shaped outer wall and a ridge pattern for an easy durable operation, so that the rotation, regardless of the reverse or forward rotation, can be operated very convenient. In the meantime, the electrical connector 30 can be attached onto the plate 31 tightly by plugging the multi-protrusion block 343 of the outer tension ring 34 into the corresponding polygonal through hole 311 of the plate 31, and into the corresponding polygonal groove 352 of the inner tension ring 35 to achieve the effect of engaging with the polygonal plug, and then the locking rod 33, the nut 331 and the locking part 36 are pressed and screwed tightly with one another, such that the outer tension ring 34, the plate 31 and the inner tension ring 35 can be pressed and attached securely. Even after a long time of use, the whole electrical connector assembly 30 is still secured stably and will not be loosened or cause a short circuit.

In summation of the description above, the electrical connector assembly of the present invention is novel and capable of achieving the expected functions and effects and complying with the patent application requirements, and thus is dully filed for patent application. While the present invention has been described by means of specific embodiments, numerous modifications and variations could be made thereto by those skilled in the art without departing from the scope and spirit of the invention set forth in the claim

What is claimed is:

1. An electrical connector assembly, installed on a plate, the plate having a polygonal through hole formed thereon, and the electrical connector assembly comprising an external rotating member, a locking rod, an outer tension ring, an inner tension ring and a locking part, wherein the external rotating member has an outer wall formed into a push handle shape and an inner surface with a screw slot; the locking rod is a long-rod shaped screw, screwed with a locking nut, and an end of the locking rod is screwed into the screw slot to reach a screwing length, and the locking nut is rotated to press the inner surface of the external rotating member; the outer tension ring axially penetrates through a through hole and has an inwardly concave polygonal slot formed on an outer surface thereof and an inner surface with a multi-protrusion block, and the polygonal slot is configured to be corresponsive to the locking nut, and the multi-protrusion block is configured to be corresponsive to the polygonal through hole of the plate, and the outer tension ring is passed through the through hole and sheathed on the locking rod, such that the locking nut is pressed into the polygonal slot, and then the outer tension ring is attached to the outer surface of the plate, such that the multi-protrusion block of the outer tension ring is plugged into the polygonal through hole, while the locking rod is passed through the polygonal through hole of the plate; the inner tension ring is axially penetrated through a through hole and has an outer surface with a polygonal groove, and the polygonal groove is configured to be corresponsive to the polygonal through hole of the plate and corresponsive to the multi-protrusion block of the outer tension ring, and the inner tension ring is attached to an inner surface of the polygonal through hole of the plate, and the locking rod is passed through the through hole of the inner tension ring, and the multi-protrusion block of the outer tension ring is plugged into the polygonal groove of the inner tension ring, and a rear end of the inner tension ring is sheathed on the locking rod by a washer, and the locking part is screwed with the corresponding locking rod.

2. The electrical connector assembly according to claim 1, wherein the push handle shaped outer wall of the external rotating member has a ridge pattern for a durable handheld operation.

3. The electrical connector assembly according to claim 1, wherein the external rotating member has a polygonal plug slot formed on an outer surface thereof and provided for plugging a tool.

4. The electrical connector assembly according to claim 1, wherein the inner surface of the external rotating member and the locking nut are provided for clamping and coupling a circuit therebetween, and the circuit is coupled to the locking rod, such that the circuit is electrically coupled to the circuit clamped and coupled between the two nuts of the locking part.

5. The electrical connector assembly according to claim 1, wherein the locking part is comprised of two nuts, and two nuts are screwed tightly with each other to enhance the pressing effect between the locking rods.

6. The electrical connector assembly according to claim 5, wherein the two nuts of the locking part are provided for clamping and coupling a circuit therebetween.

* * * * *